US005996646A

United States Patent [19]

Hockemeyer et al.

[11] Patent Number: 5,996,646

[45] Date of Patent: Dec. 7, 1999

[54] DEVICE FOR PRODUCING A LENO SELVEDGE, IN PARTICULAR FOR SHUTTLELESS LOOMS

[75] Inventors: Kurt Hockemeyer; Matthias Klöcker; Christoph Schwemmlein, all of Borken/Weseke, Germany

[73] Assignee: Klocker Entwicklungs GmbH

[21] Appl. No.: 09/077,864

[22] PCT Filed: May 21, 1996

[86] PCT No.: PCT/DE96/00882

§ 371 Date: Jun. 4, 1998

§ 102(e) Date: Jun. 4, 1998

[87] PCT Pub. No.: WO97/24479

PCT Pub. Date: Jul. 10, 1997

[30] Foreign Application Priority Data

Dec. 28, 1995 [DE] Germany ..... 195 48 955

[51] Int. Cl.[6] ..... D03C 7/08

[52] U.S. Cl. ..... 139/54

[58] Field of Search ..... 139/54, 51, 50

[56] References Cited

U.S. PATENT DOCUMENTS

| | | | |
|---|---|---|---|
| 3,613,741 | 10/1971 | Ravella | 139/54 |
| 4,166,480 | 9/1979 | Muller | 139/54 |
| 4,421,141 | 12/1983 | Brouwer | 139/54 |
| 5,518,039 | 5/1996 | Haeussler et al. | 139/54 |

FOREIGN PATENT DOCUMENTS

| | | |
|---|---|---|
| 0 306 078 | 3/1989 | European Pat. Off. . |
| 128364 | 6/1900 | Germany . |
| 1491927 | 11/1977 | Germany . |

OTHER PUBLICATIONS

Patent Abstracts of Japan, vol. 13, No. 451 (C–643), Oct. 11, 1989 (Translated Abstract) 174633 A.

JP 01 174633A (Nissan Motor Co. Ltd), Jul. 11, 1989.

*Primary Examiner*—Andy Falik

*Attorney, Agent, or Firm*—McDermott, Will & Emery

[57] ABSTRACT

A device for producing a leno selvedge, in particular for shuttleless looms comprises an electromotor with a rotor having at least two spaced guide elements for passing the leno threads. The guide elements are designed as arms with eyes at their ends for passing of the leno threads.

6 Claims, 3 Drawing Sheets

DEVICE FOR PRODUCING A LENO SELVEDGE, IN PARTICULAR FOR SHUTTLELESS LOOMS

DE 128 364 discloses a device for decorating material by means of cord twisters. Hereby, up to four threads are twisted around a core. The twisting occurs outside of the shed, so that the weft thread cannot be tied off. Finally, this device is not a device for producing a leno selvedge.

The US-A 36 13 741 discloses a leno selvedge device showing a driven rotating element, which is provided at its ends with tubes arranged crosswise for guiding the leno threads. The rotating element has at its ends a turntable connected with the rotating element for receiving spools for the leno threads. This entails that the spools are always rotating together with the rotating element, meaning that a high mass has to be sped up and braked down again.

A device as mentioned above is known out of DE-PS 44 05 776. Hereby, an electrically drivable servomotor is provided which drives a doup disc, the doup disc forming the rotor of the electrically drivable servomotor. The stator itself is mountable onto the loom by means of a carrying element, preferrably in a free space between the longitudinal braces and the healds in front of the first heald frames of the loom. More particularly the doup disc, which forms the rotor of the electrically drivable servomotor, has two opposite openings through which one leno thread at a time is led, these openings serving as guide elements. This known rotator for producing a leno selvedge in a loom works so that it completes several hundred revolutions in one direction and ties off one weft thread after each revolution. A full leno selvedge is thus achieved. On the feeding side of the two leno threads, the leno threads are twisted according to the number of revolutions of the doup disc so that, in order to undo this twisting, an inversion of the douping direction is indicated, the doup disc having to rotate in exactly the opposite direction. The number of revolutions in either direction has hereby to be the same in an average period of time. If the douping direction were not inverted, the leno threads would, some time or other, tear due to the increasing tension occasioned by the growing twisting.

In case of the known fast-running looms making up to 1200 werfts per minute, it was ascertained that after approximately 100 to 1000 revolutions in one direction an inversion of the douping direction should occur. That means that, according to the state of the art, the rotor and thus the douping disc of the electrically drivable servomotor has to be reversed every 10 to 100 second. Due to the number of strokes of a loom, the time available for inversion is of 100 milliseconds (msec) maximum. That means that the rotor of the motor has to stand still and to rotate in the reversed douping direction at full speed within 100 msec. Due to the high mass of the douping disc and of the rotor respectively, this performance can be achieved with known motors only at high cost. The idea to reduce the moved mass of the motor by choosing a rightaway smaller motor will naturally arise. The danger incurred in this case is that, if the rotor and thus the douping disc are given a smaller diameter, the shedding occurring between the two leno threads guided through the douping disc is not sufficient, so that the weft thread cannot be inserted accurately. Moreover, the threads can still stick together, impeding the formation of a clean selvedge.

SUMMARY OF THE INVENTION

The object of the invention is therefore to provide a device of the abovementioned type, which makes it possible to manufacture a correct full leno selvedge even in fast running looms.

The solution of the object is to design the guide elements as arms provided at their ends with eyes through which the leno threads are passed. The arms themselves are easy to form, since they are hardly ever subjected to stress. They thus represent a relatively neglectable mass. Due to the arrangement of the arms on the rotor of an electromotor, the dimensions of the rotor is independent of the desired aperture angle of the shed. That means that a small motor with an accordingly small rotor can be chosen, this motor having also a correspondingly small mass, since due to the arrangement of the arms on the rotor, the technical designer is now free, except for the output requirements, to choose the size and the diameter of the motor. That's why motors with a small diameter and with accordingly small moved masses can be used without risking to impede a correct shed aperture, since the length of the arms arranged on the rotor permits to choose freely the spacing of the eyes in the arms and thus the size of the shed aperture.

According to an advantageous characteristic of the invention, the rotor in the area of its rotational axis, has a boring for passing the leno threads. That means that the leno threads can be passed through the electromotor by a boring provided centrally on it, improving thus the thread guiding, particularly with regard to a possible twisting in the area of the boring in the electromotor. More particularly, the arms are arranged on the front side of the rotor of the electrometer, this side being directed towards the material; hereby each arm is designed as a hook at its ends, whereas the eye for passing the leno threads is provided in the area of the hook-shaped curve. The eye can be provided with inserts that reduce wear and tear of the eye due to the guiding of the leno threads; sleeve-like inserts made of ceramic materials have particularly been thought of.

According to another characteristic of the invention, the electromotor is arranged onto the loom in such a way that the rotational axis runs either parallel or in an angle of up to 90° to the warp threads. Particularly when the angle nearly reaches 90°, the device is optimally brought directly to the material edge so that a leno selvedge can also be executed at the very end of the material. According to still another characteristic of the invention, it may be necessary to arrange further arms accordingly on the opposite front side of the rotor of the electromotor, parallel to the arms arranged on the front side directed towards the material. These additional arms may become necessary in order to guarantee a correct twisting of the leno threads in the area of the feeding of the leno threads from the spools. This is necessary in order to permit to undo the twisting of the leno threads in the same way as they were twisted in the feeding area of the threads from the spools by inverting the rotational direction of the rotor. This difficulty does not arise when the rotor of the electromotor is arranged with its rotational axis parallel to the warp threads of the loom.

The invention is explained in more details according to the drawings.

DESCRIPTION OF THE PREFERRED EMBODIMENT(s)

Figure 1:
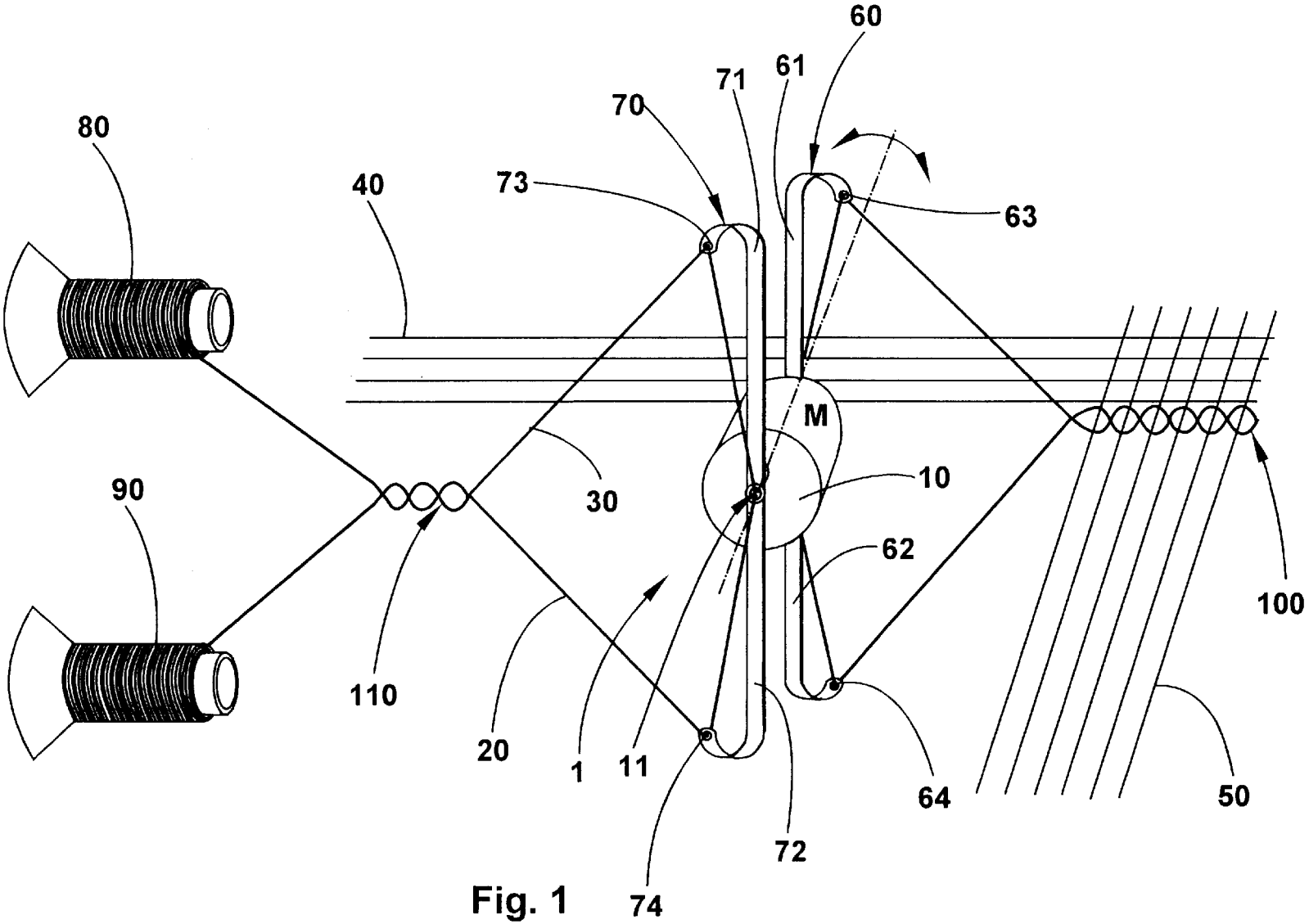
FIG. 1 is a diagram showing the nearly perpendicular arrangement of the device according to the invention to the material, whereas the healds and the reed have been omitted in order to guarantee a greater clearness.
Figure 2:
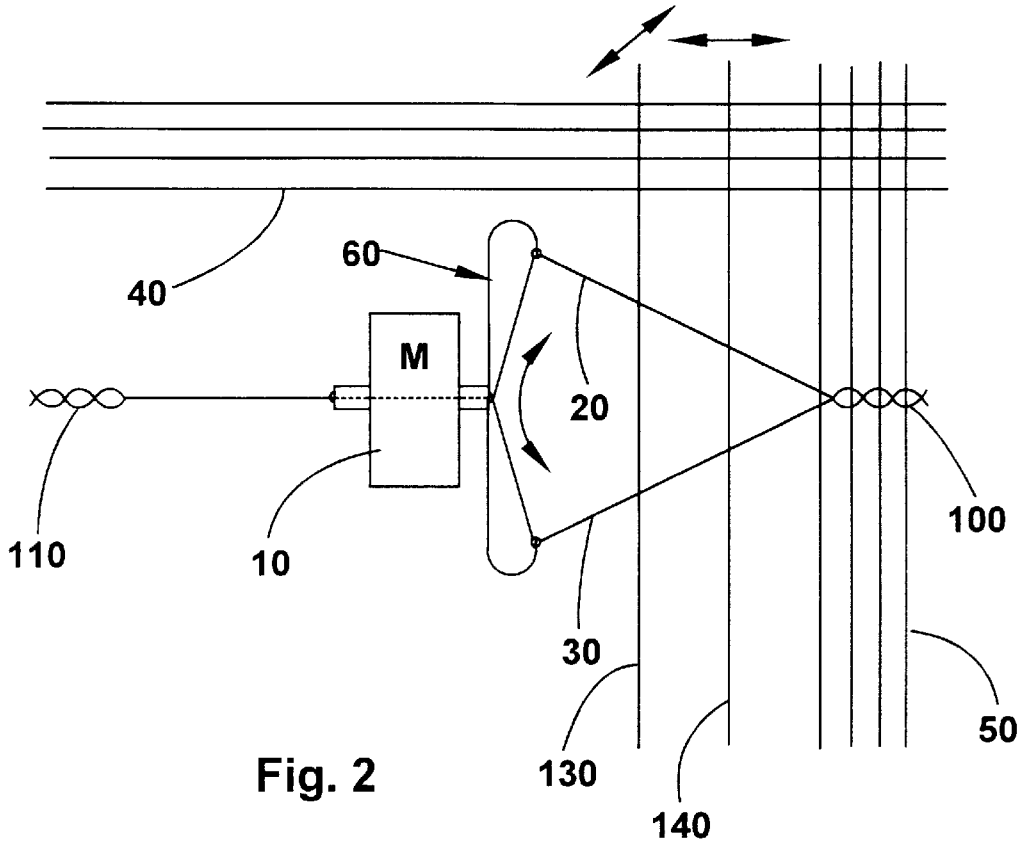
FIG. 2 is a diagram showing the device, the rotational axis of the electromotor running parallel to the warp threads.
Figure 3:
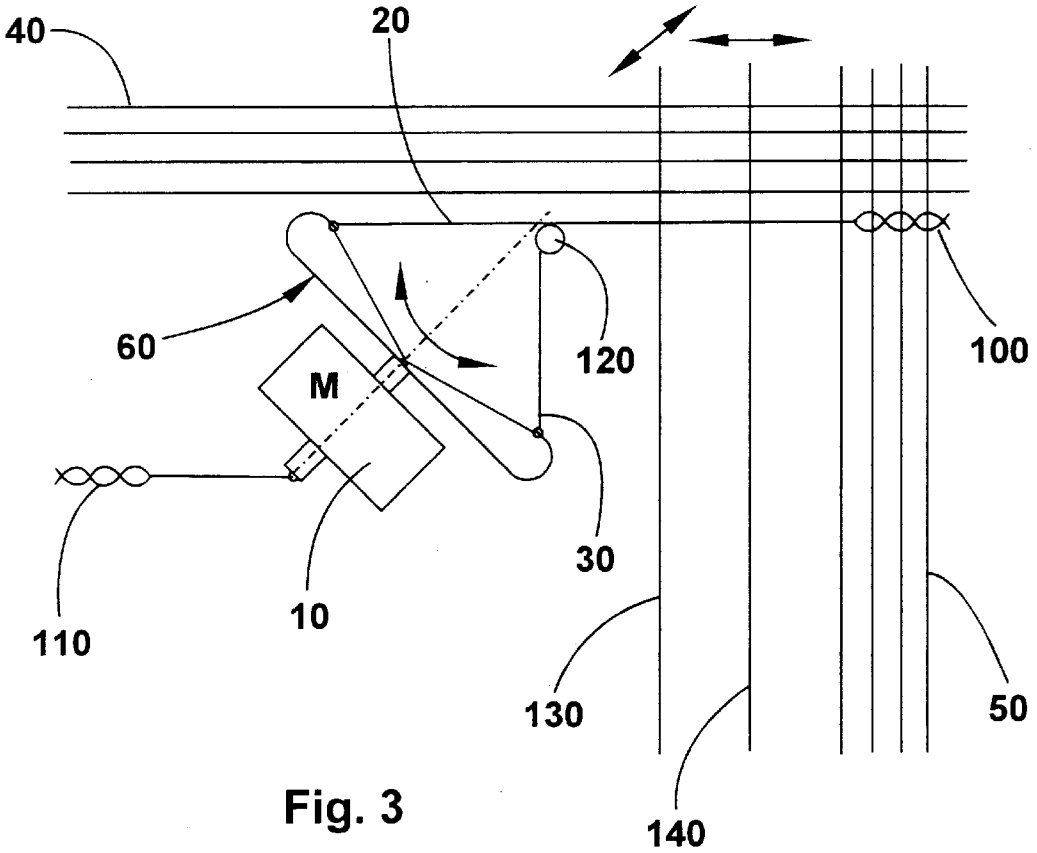
FIG. 3 shows the electromotor eat an angle of approximately 45° to the warp threads.

In the device 1 shown in the FIGS. 1 to 3, a motor referred to as a whole with the numeral 10 is provided, which has a central boring 11 for passing the leno threads 20, 30. In the embodiment shown in FIG. 1, where the rotational axis is transversal to the warp threads 40, that means that it runs essentially parallel to the weft threads 50, two pairs of arms 60, 70 are provided. Each pair of arms 60, 70 consists of two arms 61, 62 and 71, 72 respectively. The two pairs of arms 60, 70 are running parallel to each other and are fastened each on the front side of the rotor of the electromotor 10, as can clearly be seen on FIG. 1. The arms 61, 62 and 71, 72 resp. are hook-shaped and have in the area of the hook-shaped Curve the eyes 73, 74 and 63, 64 resp. These eyes serve for passing the leno threads 20, 30, which are unwinded from the thread spools 80, 90.

Figure 4:
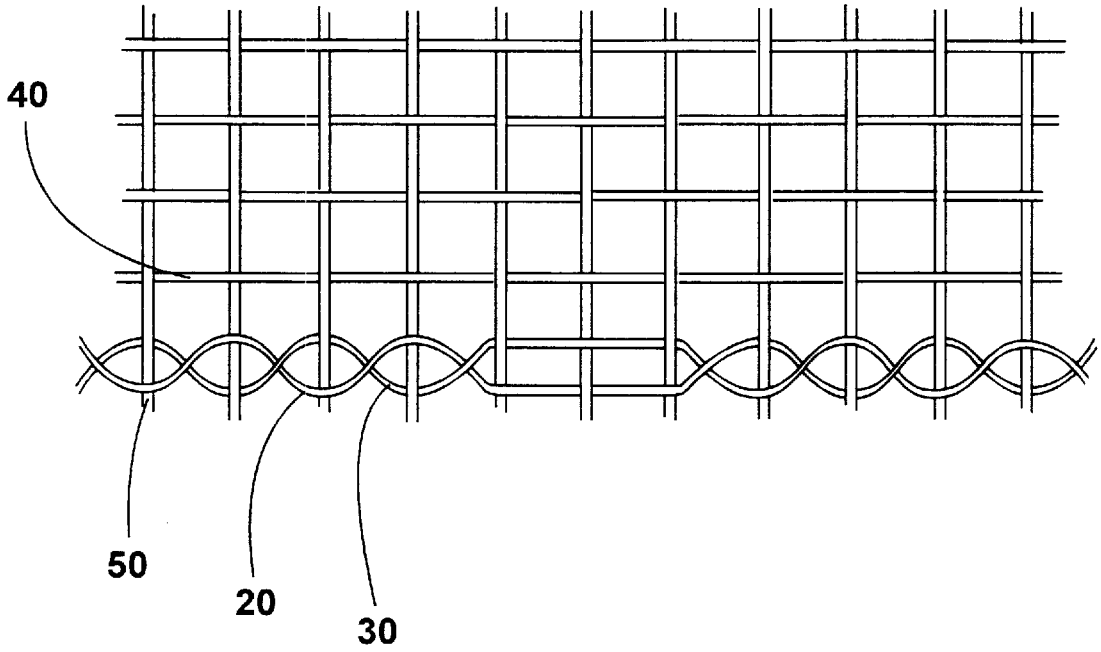
FIG. 4 shows the binding diagram of a full leno selvedge.

When the pairs of arms 60, 70 are rotating, a full leno selvedge 100 is executed in the area of the material (FIG. 4). In the area where the leno threads 20, 30 are fed from the thread spools 80, 90, the threads (at 110) are also twisted, and untwisted again when the rotating direction of the rotor is reversed after a given number of revolutions in one direction. The weft threads 50 are inserted between the leno threads and prevent the leno selvedge 100 from untwisting. That means that even when twisting 110 is untwisted, on the other side, in the area of the material, another selvedge is executed by twisting with the corresponding weft threads.

The device is working in such a way that, the rotor of an electromotor is driven so that its rotation is synchronous with the moving of the heald so that the necessary shed aperture for the weft insertion is given and a selvedge is tied in connection with the twisting. As an option it is also possible to achieve an early tying by offsetting correspondingly the phases in the synchronisation between the rotational movement of the rotating element and the heald movement. That means that such a device is working independently of the heald which is not the case with the selvedge machines accomodated on the heald frames.

In the arrangement of the rotational axis running parallel to the warp threads 40 and shown in FIG. 2, where the healds are referred to with numeral 130 and the reed with numeral 140, only little problems naturally occur when the leno threads 20, 30 are fed into the device. In the position of the electromotor with therefore relative to the material as it is shown in FIG. 2, the spacing from the material is quite big, so that the leno selvedge cannot be arranged directly on the material.

The selvedge can be arranged much nearer to the material when the device is brought into the position according to FIG. 3. Here, the device is positioned at an angle of approximately 45° to the material.

Hereby though, a thread guiding element 120 designed as a reel or a roller is provided which makes it possible to guide the threads to the material in order to achieve a correct shed aperture.

The tying which is made with such a device (FIG. 4) is a so-called full leno tying, that means that each weft thread is completely tied off by the tying. Although only three threads are involved, such a selvedge is extremely solid and is not too thick thanks to the use of only three threads, so that the material does not lay thick on the beam in the edge area, and thus does not loose its shape.

We claim:

1. Device for producing a leno selvedge, particularly for a loom, comprising an electromotor with a rotor, whereas the rotor has at least two spaced guide elements for passing the leno threads, wherein the guide elements comprise arms with eyes at their ends for passing of the leno threads.

2. Device according to claim 1, wherein the rotor of the electromotor has a bore generally along its rotational axis for passing the leno threads.

3. Device according to claim 1, wherein at least one of said arms has at its end a hook-shaped curve, and whereas the eye for passing the leno threads is provided in the area of the hook-shaped curve.

4. Device according to claim 1, wherein the arms are arranged on a front side of the rotor of the electromotor.

5. Device according to claim 4, comprising further arms that are provided on a rear side of the rotor, opposite the front side, and parallel to the arms on the front side of the rotor.

6. Device according to claim 1, wherein the electromotor is adapted to be arranged on the loom in such a way that the rotational axis runs either parallel or in an angle of up to 90° to the warp threads.

* * * * *